United States Patent [19]

Reemet et al.

[11] Patent Number: 4,736,897

[45] Date of Patent: Apr. 12, 1988

[54] DISINTEGRATOR

[75] Inventors: Olev G. Reemet, Tallin; Vladimir P. Bei, Moscow; Iokhannes A. Khint, Tallin; Bella U. Shagarova, Tallin; Ants A. Sallo, Tallin; Pukhm, Tallin, all of U.S.S.R.

[73] Assignee: Spetsialnoe Konstruktorsko Tekhnologicheskoe Bjuro "Dezintegrator", Tallinn, U.S.S.R.

[21] Appl. No.: 890,775

[22] PCT Filed: Jan. 17, 1985

[86] PCT No.: PCT/SU85/00004

§ 371 Date: Jun. 27, 1986

§ 102(e) Date: Jun. 27, 1986

[87] PCT Pub. No.: WO86/03695

PCT Pub. Date: Jul. 3, 1986

[30] Foreign Application Priority Data

Dec. 21, 1984 [SU] U.S.S.R. ..... 3822105

[51] Int. Cl.[4] ..... B02C 13/282

[52] U.S. Cl. ..... 241/188 A; 241/285 A

[58] Field of Search ..... 241/188 R, 187, 188 A, 241/37, 285 R, 285 A, 259.1

[56] References Cited

U.S. PATENT DOCUMENTS

| | | | |
|---|---|---|---|
| 4,201,349 | 5/1980 | Walsh | 241/259.1 X |
| 4,249,703 | 2/1981 | Korenev et al. | 241/259.1 X |
| 4,378,911 | 4/1983 | Adams et al. | 241/188 AX |

FOREIGN PATENT DOCUMENTS

| | | | |
|---|---|---|---|
| 301168 | 8/1971 | U.S.S.R. . | |
| 317420 | 1/1972 | U.S.S.R. . | |
| 328936 | 3/1972 | U.S.S.R. . | |
| 297237 | 8/1972 | U.S.S.R. . | |
| 448031 | 12/1974 | U.S.S.R. . | |
| 806114 | 2/1981 | U.S.S.R. . | |
| 835487 | 6/1981 | U.S.S.R. | 241/285 AX |

OTHER PUBLICATIONS

Politekhnischesky Slovar, 1976

*Primary Examiner*—Mark Rosenbaum

*Attorney, Agent, or Firm*—Burgess, Ryan and Wayne

[57] ABSTRACT

A disintegrator comprising a housing accommodating rotors with bladed wheels (5), and electric motors (3), a housing of each electric motor (3) having two flanges (7 and 8) of which one flange (7) is rigidly connected to the front portion of the housing of the electric motor (3) and to movable or stationary station (2 or 1) of the housing of the disintegrator, whereas the second flange (8) is secured on a support (9). One of the electric motors with the movable section (2) of the housing is capable of movement under the action exerted thereon by a screw mechanism.

7 Claims, 3 Drawing Sheets

DISINTEGRATOR

FIELD OF THE INVENTION

This invention relates to equipment for grinding, mixing, and activating a range of materials, and more particularly to disintegrators.

BACKGROUND OF THE INVENTION

There is known a disintegrator comprising a housing accommodating rotors secured on a shaft journalled in bearing supports, the other end of the shaft carrying a pulley connected by a belt transmission to an electric motor. All these elements are arranged on a hollow shaft through which a material to be treated is admitted to the rotor chamber (cf., USSR Inventor's Certificate No. 448,031, Int. Cl. B 02 C 13/22, published 1971).

Servicing of the rotors in this disintegrator is difficult, because the rotors cannot be moved relative to each other for easy replacement. Replacement of the rotors requires that the entire machine be taken apart, which entails high labor and time expenditures.

Also, for increasing the capacity of the disintegrator, it is necessary to provide rotors of larger size and consequently use a bulkier hollow shaft for ensuring structural reliability and, accordingly, larger size bearing assemblies.

There are further known disintegrators comprising a housing which accommodates rotors rotating in the opposite directions, these rotors being mounted on shafts journalled in bearing supports. The other ends of the shafts carry pulleys connected by a belt transmission to electric motors. The housing of the disintegrator includes two sections of which one is stationary, whereas the other can move axially by means of a rack mechanism. The disintegrator is provided with lock means for joining together the housing sections (cf., U.S. Pat. No. 4,378,911, published 1983).

Although this disintegrator has a provision for drawing the housing apart to replace and serve the rotors, in order to carry out this operation, it is necessary to release the lock means and remove the belt transmission, which is labor and time consuming. Connection of the shafts carrying the rotors with the electric motors by means of bearing supports and belt driven pulleys makes the disintegrator structurally overcomplicated and bulky.

In addition, the lock means are not designed to align the two sections of the housing when closing, which may result in displacement of the disintegrator parts and can be the cause of less reliable operation.

One more prior art disintegrator (a prototype) comprises a detachable housing accommodating rotors with bladed wheels, electric motors the shafts of which carry the rotors, and a bed on which the major units of the disintegrator are mounted (cf., USSR Inventor's Certificate No. 317,420, Int. Cl. B 02 C 23/00, published 1968).

However, servicing of this disintegrator is not sufficiently convenient, because splitting the housing apart by moving at least one of its sections together with the electric motor requires disassembly of the bracing elements by which they are attached to the bed.

In addition, the provision of the bed makes the disintegrator heavier and bulkier.

Another disadvantage is that this prior art disintegrator construction fails to provide forced cooling of the electric motors by a medium used in the production process.

SUMMARY OF THE INVENTION

The present invention is directed toward the provision of a disintegrator in which a rigid connection of electric motors to housing sections would ensure a more reliable operation, easier servicing, and reduced overall dimensions of the disintegrator.

The aims of the invention are attained by that in a disintegrator comprising a detachable housing accommodating rotors with bladed wheels rotating in the opposite directions, and electric motors the shafts of which carry the rotors, according to the invention, the housing of each electric motor is provided with two flanges, one of which is rigidly connected to the front section of the housing of the disintegrator, whereas the second flange is secured on a support, at least one of the electric motors with the adjacent part of the housing being capable of movement along guides by means of a screw mechanism, the sections of the housing of the disintegrator having mutually centering elements.

Such an arrangement ensures smaller overall size of the disintegrator, since rigid connection of the electric motors to the housing of the disintegrator makes it possible to dispense with a bed, and affords easier servicing, because the housing of the disintegrator can be opened and closed by the screw mechanism without resorting to the removal of disintegrator parts by merely jointly moving the movable part of the housing with the electric motor attached thereto. The structural reliability is further assured by the provision of mutually centering elements at the two housing sections being drawn together, which prevents these parts from displacement during closing the disintegrator and which takes up radial loads in the course of operation of the disintegrator.

According to one feature of the invention, the screw mechanism can be fashioned as a threadingly engageable pair a fixed element of which is connected to a shock absorbing base on which the housings of the disintegrator and electric motors are mounted, whereas the movable element is connected to the electric motor adjacent the movable part of the housing of the disintegrator. The use of the screw mechanism in the form of a threadingly engageable pair ensures reliable closing and opening of the disintegrator by such a small-size arrangement.

Preferably, the screw mechanism includes several threadingly engageable pairs having fixed elements thereof connected to the stationary section of the housing of the disintegrator, whereas the movable elements are connected to the electric motor adjoining the movable section of the housing, the ends of the movable elements carrying sprockets embraceable by a common chain, one of the sprockets being a drive sprocket.

Such an arrangement of the screw mechanism allows, apart from reliably closing and opening the housing of the disintegrator, to move large-size heavy electric motors of high capacity disintegrators, as well as to take up axial loads by the elements of the threadingly engageable pairs and ensure rigid connection of the sections of the housing of the disintegrator without using additional lock means.

According to one more feature of the present invention, the disintegrator has casings connected to at least one of the flanges of the electric motor and rigidly connected to the movable and stationary sections of the housing of the disintegrator, the inside of the casings accommodating the electric motors capable of movement on roller supports along guides, whereas the movable elements of the threadingly engageables pairs are connected to the casing, which is rigidly affixed to the movable section of the housing, the casings and the housing of the disintegrator being mounted on the shock absorbing base.

The provision of the casings in the proposed disintegrator construction makes it possible to add to structural rigidity of the machine, which is especially important when using large-size heavy electric motors for high capacity disintegrators, thanks to the attachment of at least one of the flanges of the electric motors to the casing rigidly affixed to the housing of the disintegrator. To facilitate servicing of the electric motors during that mounting and dismantling, the casing has roller supports for the electric motor to move thereon. The electric motors can be removed, for example, by using thrust or brace member set between the shafts of the electric motors, while the screw pairs are actuated to close the rotor chamber. The arrangement of the movable and fixed elements of the screw pairs at the outside of the casing provides easy access for servicing.

A shock absorbing means is provided for suppressing vibrations during operation of the disintegrator.

To ensure cooling of the electric motors, the casings have covers with inlet tubes, whereas the flanges of the electric motors have holes to convey gas or air admitted through the tubes. This enables, for example, to cool the electric motors by gas in explosion hazardous situations.

According to one more feature of the present invention, the housing of the disintegrator accommodates discs, which form with the sides of the housing opposite to the sides to which the flanges of the electric motors are attached chambers communicating at one side with the atmosphere through holes provided in the housing and having adjustment valves, and at the other side with rotor chambers through clearances between the discs and a shaft hub. This arrangement makes it possible by sucking air or gas outside through the chamber, clearance between the discs, shaft hub and rotor chamber to the discharge tube by an outside fan means to prevent penetration of dust-laden air from the rotor chamber to the bearing assembly, as well as to cool the rotors.

BRIEF DESCRIPTION OF THE ACCOMPANYING DRAWINGS

The invention will now be described in greater detail with reference to various preferred embodiments thereof taken in conjunction with the accompanying drawings, in which.

BEST MODE OF CARRYING OUT THE INVENTION

Figure 1:
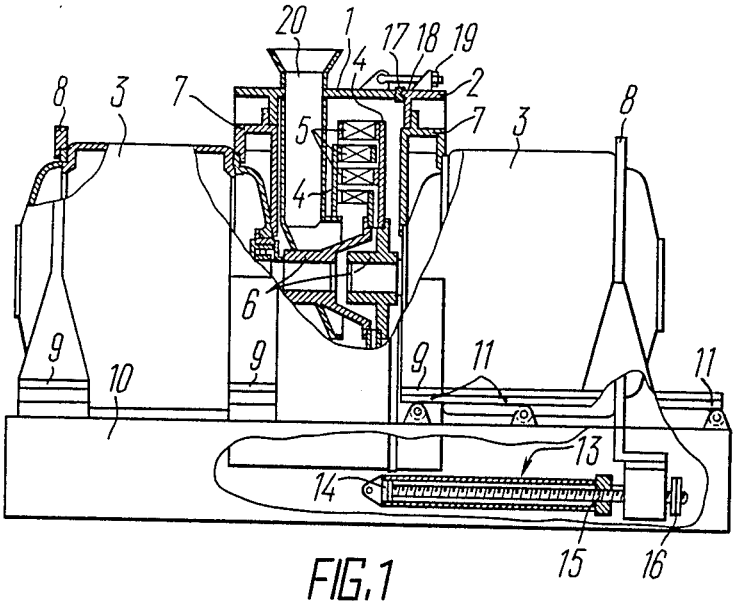
FIG. 1 is a front view of the proposed disintegrator with partially cut-away sections.

A disintegrator comprises a housing which includes stationary section 1 (FIG. 1), a movable section 2, and electric motors 3. Secured inside the housing are rotors having the form of discs 4 with bladed wheels 5 attached thereto. The discs 4 are attached to hubs 6 fitted onto shafts of the electric motors 3.

For supporting the electric motors 3 the housing of each electric motor is provided with two flanges 7 and 8, one of which, flange 7, being rigidly connected to the front portion of the housing of the electric motor 3 and with the movable and stationary parts 2 and 1, respectively, of the housing of the disintegrator.

The second flange 8 bears on a support 9 mounted on a shock absorbing base 10.

At least one of the electric motors, viz. motor 3, and an adjacent thereto section 2 of the housing of the disintegrator are capable of movement along guides 11 and roller supports 12 (FIG. 2) under the action of a screw mechanism 13 (FIG. 1). This mechanism consists of a threadingly engageable pair, a fixed element 14 of which is linked to the shock absorbing base 10 on which the housings of the disintegrator and electric motors 3 are mounted.

A movable element 15 of this pair is connected to the electric motor 3, which moves together with the section 2 of the housing of the disintegrator adjacent thereto.

The movable element 15 is rotatable by a drive 16.

For alignment of the disintegrator when closing, and for taking up the radial forces in the course of operation, the sections 1 and 2 of the housing are provided with mutually centering elements in the form of grooves 17 and projections 18 capable of intimate engagement.

In order to ensure rigid fixation of the stationary and movable sections 1 and 2 of the disintegrator, there are provided retainer means in the form of locks 19.

Figure 2:
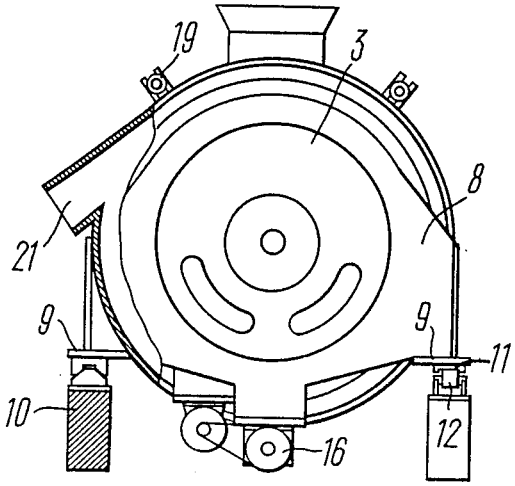
FIG. 2 is a side view of the disintegrator illustrated in FIG. 1.

The disintegrator comprises a feeding funnel 20 to be filled with a material to be treated, and a discharge pipe 21 (FIG. 2).

Figure 3:
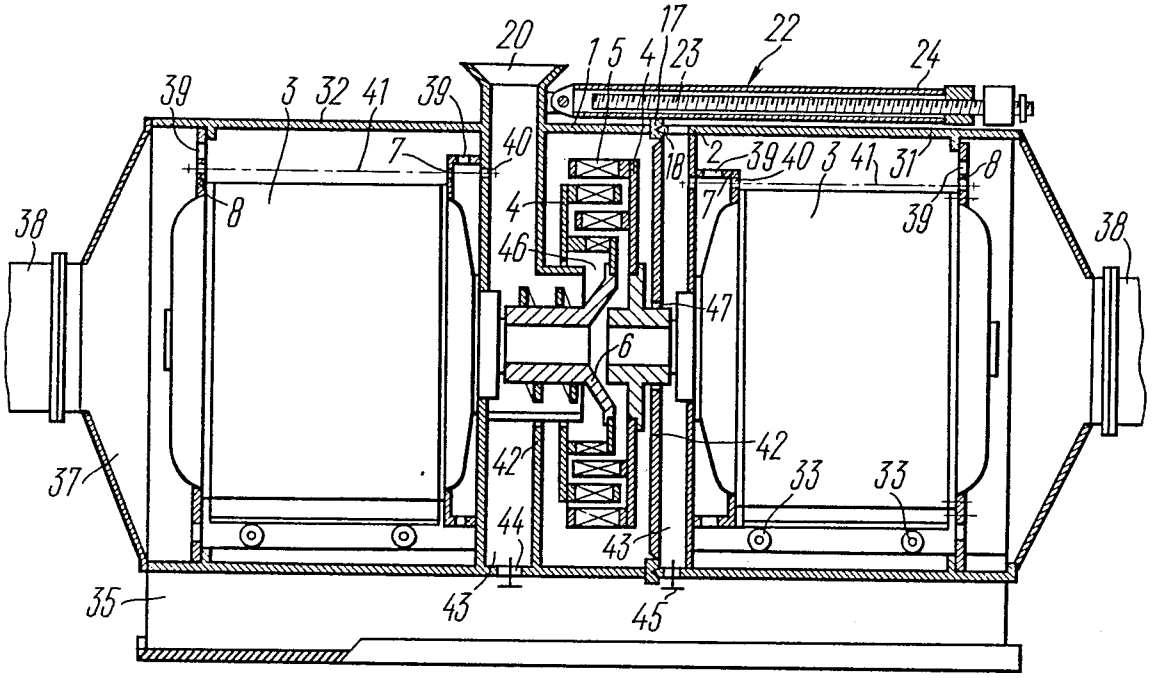
FIG. 3 is a front view of another modified form of the proposed disintegrator with partial sections.
Figure 4:
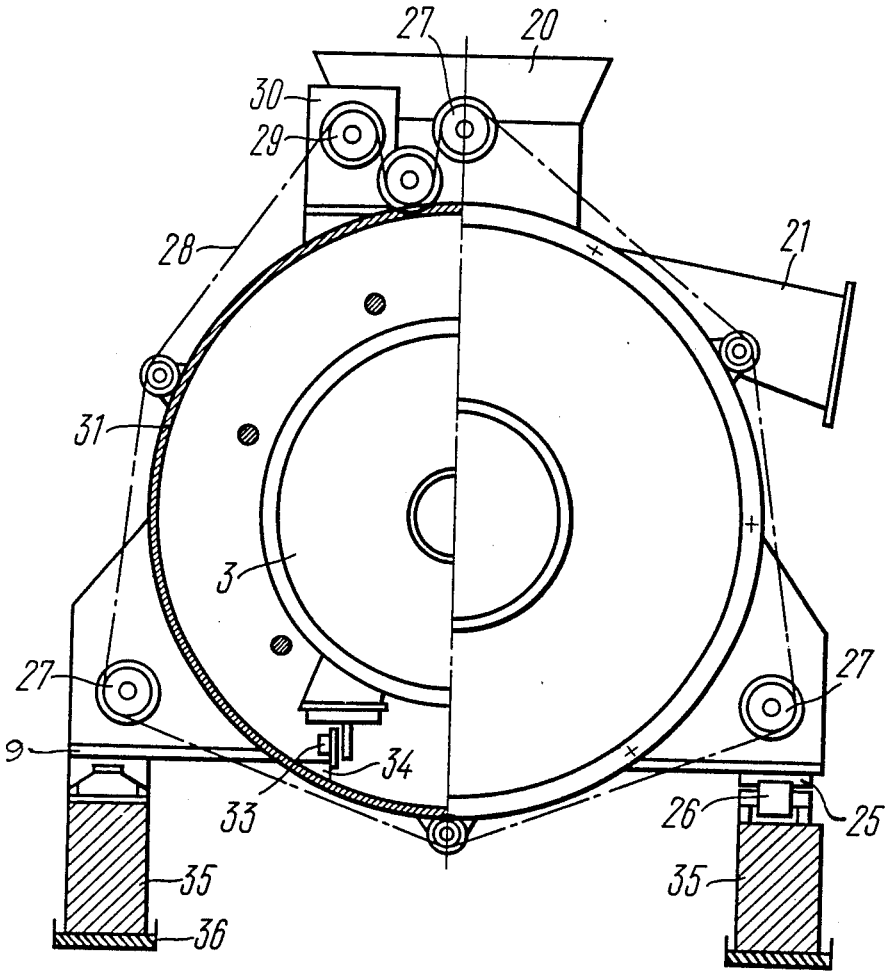
FIG. 4 is a side view of the disintegrator shown in FIG. 3.

With reference to FIG. 3, there is shown a modified form of the proposed disintegrator in which the screw mechanism includes several threadingly engageable pairs 22 with fixed elements 23 thereof being attached to the stationary section 1 of the housing of the disintegrator, whereas movable elements 24 are connected to the electric motor 3, which is capable of movement with the adjacent section 2 of the housing along guides 25 (FIG. 4) and roller supports 26.

Sprockets 27 are arranged at the ends of the movable elements embraced by a common chain 28. The chain 28 is driven by a sprocket 29 secured on the shaft of a motor 30.

The disintegrator has casings 31 and 32 (FIG. 3) of which the casing 31 is rigidly connected to the movable section 2 of the housing of the disintegrator, and the casing 32 is connected to the stationary section 1 of this housing, the two casings 31 and 32 being connected to the flanges 8.

The electric motors 3 are accommodated inside the casings 31 and 32 to be capable of travel on roller supports 33 along guides 34.

The movable elements 24 of the threadingly engageable pairs 22 are linked with the casing 32.

The casings 31 and 32 and the housing of the disintegrator are mounted on a shock absorbing base having the form of a beam 35 (FIG. 4) bearing on a resilient member 36, such as one fabricated from rubber.

The casings 31 and 32 (FIG. 3) are provided with covers 37 having inlet tubes 38, whereas the flanges 7 and 8 are provided with holes 39 to ensure the passage of gas or air admitted through the tubes 38 to cool the electric motors 3.

The flanges 7 and 8 and sections 1 and 2 of the housing have through holes 40, which receive studs 41 to ensure an integral rigid construction of the disintegrator.

Disc elements 42 are further provided inside the housing of the disintegrator to form chambers 43 with the walls of the housing opposite to the sides to which the flanges 7 of the electric motors 3 are attached; these chambers 43 communicating at one side with the atmosphere through holes 44 provided in the housing and having adjustable valves 45. At the other side the chambers 43 communicate with a rotor chamber 46 through clearances 47 between the discs 42 and hub 6.

The disintegrator represented in FIG. 3 operates in the following manner.

The material to be treated is fed through the funnel 20 to be thrown by the hub 6 onto the bladed wheels 5 of the rotors. Under the action of centrifugal forces the material is caused to move through the rows of bladed wheels and escape through the discharge tube 21.

In the course of operation air or gas is sucked in through the valves 45, chambers 43, and clearance 47 to the rotor chamber 46 for cooling the working parts of the disintegrator and preventing the penetration of dust from the rotor chamber 46 to the bearings of the electric motor 3. Air or gas is conveyed through the inlet tubes 38 and holes 39 of the flanges 7 and 8 to cool the electric motors 3, and ensure explosion safety, when operating in an explosion hazardous environment. Vibrations are damped during operation of the disintegrator by the shock absorbing means including the beams 35, and the shock absorbing member 36 fabricated, for example, from rubber. When opening and closing the movable section 2 of the housing of the disintegrator with the electric motor 3 by the threadingly engageable pairs 22, they are moved along the guides 34 on rollers 33. When dismantling the electric motors 3, a brace element is interposed between the shafts of the electric motors 3 for the threadingly engageable pairs 22 functioning for closing the housing of the disintegrator to force the electric motors 3 outside on rollers 33 and guides 34.

During operation of the disintegrator the threadingly engageable pairs 22 ensure rigid connection of the sections 1 and 2 of the housing, and therefore are subject to the action of axial loads, whereas the centering elements 17 and 18 take up radial loads.

Extra structural rigidity of the disintegrator is ensured by drawing together the flanges 7 and 8 and sections 1 and 2 of the housing by the studs 41, as well as by connecting the flanges 8 of the electric motors 3 to the casings 31 and 32 in turn rigidly affixed to the sections 1 and 2 of the housing of the disintegrator.

INDUSTRIAL APPLICABILITY

The invention can be used with success in the industry catering for civil engineering, ferrous and non-ferrous metallurgy, chemical industry, and elsewhere.

We claim:

1. A disintegrator comprising:

a housing having a moveable section and a stationary section;

a first electric motor connected with said moveable section and having a first rotatable shaft;

a second electric motor connected with said stationary section and having a second rotatable shaft;

a first set of rotors mounted on said first rotatable shaft for rotation in a first direction and having a first set of bladed wheels;

a second set of rotors mounted on said second rotatable shaft for rotation in a second direction opposite to said first direction having a second set of bladed wheels;

support means for supporting the first and second electric motors;

first fixed coupling flanges fixed to said moveable section and said stationary section at first ends of said electric motors, respectively;

second fixed coupling flanges resting on said support means and located at second, opposite ends of said electric motors, respectively;

displacement means for displacing said moveable section and said first electric motor with respect to said stationary section and for absorbing axial forces generated between the moveable and stationary sections, said displacement means including means for causing said moveable section and said first electric motor to move with respect to said support means and including guides, a plurality of screw mechanisms spaced along the circumference of the housing for moving the moveable section and first electric motor with respect to the stationary section with the aid of the guides, and drive means for simultaneously driving said screw mechanisms uniformly to cause said moveable section and said first electric motor to move with respect to said stationary section; and first and second centering element means mounted on the moveable section and stationary section, respectively, for aligning the moveable section and stationary section when said moveable section and stationary section are locked together and for absorbing radial forces between the moveable and stationary sections, said first and second centering element means being engaged with each other when said moveable section and stationary section are locked together.

2. A disintegrator according to claim 1; further including a shock absorbing base on which said movable section and said stationary section of said housing and said electric motors are mounted; and wherein each screw mechanism includes a fixed element connected to said shock absorbing base and a movable element screw-threadedly connected with said fixed element adjacent the movable section of the housing.

3. A disintegrator according to claim 2; wherein each fixed element is connected to the stationary section of the housing and each movable element is connected with the first electric motor adjacent the movable section of the housing, each screw mechanism further including a sprocket secured at an end of each respective movable element; and said drive means includes a common chain extending around the sprockets and one of the sprockets constituting a drive sprocket.

4. A disintegrator according to claim 3; further including a first casing connected to at least one of the flanges and rigidly attached to the movable section of the housing and accommodating the first electric motor therein; a second casing connected to at least one of the flanges associated with the second electric motor and rigidly attached to the stationary section of the housing for accommodating the second electric motor therein; the first and second casings and the housing being mounted on a shock absorbing frame; said screw mechanisms being connected to said first casing; and further including guides for guiding said electric motors in said respective casings and roller supports for slidably moving said electric motors along said guides in said respective casings.

5. A disintegrator according to claim 4; wherein each of said casings includes a cover having an inlet tube and said first and second flanges have holes therein to conduct a gas admitted through the inlet tubes for cooling the electric motors.

6. A disintegrator according to claim 1; wherein said first and second flanges, said movable section and said stationary section are provided with through holes which receive studs to form a rigid and structurally integrated disintegrator.

7. A disintegrator according to claim 1; wherein said housing has disks therein which form, with sides of said housing, chambers communicating at one side thereof with ambiant atmosphere through holes 44 provided in said housing, and at an opposite side of said chambers through clearances between the disks and a central hub with a chamber in which the rotors are located, and further including adjustable valves provided in said holes in the housing through which the chambers communicate with ambiant atmosphere.

* * * * *